US007219455B1

(12) United States Patent
Lee

(10) Patent No.: US 7,219,455 B1
(45) Date of Patent: May 22, 2007

(54) THREE-VIEW FOLDABLE CALENDAR

(76) Inventor: Dong Hwi Lee, 9925 Painter Ave., #J, Whittier, CA (US) 90605

( * ) Notice: Subject to any disclaimer, the term of this patent is extended or adjusted under 35 U.S.C. 154(b) by 75 days.

(21) Appl. No.: 11/011,975

(22) Filed: Dec. 15, 2004

(51) Int. Cl.
*G09F 3/04* (2006.01)

(52) U.S. Cl. ..... 40/119; 283/2; 283/4

(58) Field of Classification Search ..... 40/111, 40/119, 107; 283/2–4, 115, 117, 27.1; 281/21.1, 281/16
See application file for complete search history.

(56) References Cited

U.S. PATENT DOCUMENTS 600,253 A * 3/1898 Barnes ..... 283/64.1
733,841 A * 7/1903 Holm ..... 462/57
1,450,261 A * 4/1923 Robinson ..... 281/16
2,283,980 A * 5/1942 Fay ..... 281/16
3,090,143 A * 5/1963 Arnold ..... 40/119
4,947,564 A * 8/1990 Reece et al. ..... 401/110

* cited by examiner

*Primary Examiner*—Cassandra Davis
(74) *Attorney, Agent, or Firm*—Albert O. Cota

(57) ABSTRACT

A three-view foldable calendar (10) consisting of a single integrated structure (12) that includes three sections: an upper section (14), a center section (16) and a lower section (18). When the calendar (10) is to be stored or mailed, the upper section (14) and the lower section (18) are folded over the center section (16) to allow a small compact structure to be formed. The upper section (14) has adjacent an upper edge (24) a centered hanging hole (36) into which is inserted a pin that secures the calendar (10) to a wall. When the calendar (10) is placed in a viewing configuration it is hung on the wall which allows three consecutive calendars months to be displayed for comparative viewing.

1 Claim, 5 Drawing Sheets

THREE-VIEW FOLDABLE CALENDAR

TECHNICAL FIELD

The invention pertains to the general field of wall-hanging calendars and more particularly to a wall-hanging calendar that allows three consecutive months to be displayed and that can be compactively folded for storage or mailing.

BACKGROUND ART

The use of prior art calendars can be traced from the Julian calendar which was in use around 40 B.C. to the Gregorian calendar that was adopted in the U.S. in 1752 and is now in common use throughout the world. Most of the prior art calendars are designed to display one month at a time. In less common use are calendars that display two or three calendar months. The prior art calendars that display three consecutive months are generally difficult to fold into a package that will not crease the display surface of the calendar. Also, they are typically not dimensioned to be folded into a compact package that is easily mailed.

The instant triple-view foldable calendar solves the creasing and folding problems prevalent in the prior art by having three equally dimensioned, articulated sections: an upper section, a center section and a lower section. The upper and lower sections fold inward into the center section to form a compact, flat package that will not crease the monthly display and that is suitable for mailing. The three articulated sections are easily extended to allow three consecutive months to be viewed.

A search of the prior art did not disclose any literature or patents that read directly on the claims of the instant invention.

DISCLOSURE OF THE INVENTION

The three-view foldable calendar is designed to be folded into a compact package during storage or mailing and in a three-view viewing configuration that allows three consecutive months to be displayed.

The calendar is comprised of three sections: an upper section, a center section and a lower section. The upper section has twelve pages wherein each page has an upper edge and a lower edge. The center section consists of only one page having an upper edge and a lower edge. The upper edge of the center section is foldably attached to the lower edge of the upper section preferably by a spiral fastener. The lower section also has twelve pages wherein each page has an upper edge and a lower edge. The upper edge of the lower section is also attached by a spiral fastener to the lower edge of the center section.

The twelve three-view viewing configurations are comprised of:

a) a first viewing configuration wherein the previous month of December together with the current month of January and February are displayed, b) a second viewing configuration wherein the current month of January, February and March are displayed, c) a third viewing configuration wherein the current month of February, March and April are displayed, d) a fourth viewing configuration wherein the current month of March, April and May are displayed, e) a fifth viewing configuration wherein the current month of April, May and June are displayed, f) a sixth viewing configuration wherein the current month of May, June and July are displayed, g) a seventh viewing configuration wherein the current month of June, July and August are displayed, h) an eighth viewing configuration wherein the current month of July, August and September are displayed, i) a ninth viewing configuration wherein the current month of August, September and October are displayed, j) a tenth viewing configuration wherein the current month of September, October and November are displayed, k) an eleventh viewing configuration wherein the current month of October, November and December are displayed, and l) a twelfth viewing configuration wherein the current month of November, December together with the following-year month of January are displayed.

In view of the above disclosure the primary object of the invention to produce a calendar that can be easily folded for storage or mailing, that can be extended into three sections that display three consecutive months and that allows a lapsed three-view display to be easily removed and replaced with a current three-view display.

In addition to the primary object of the invention it is also an object of the invention to produce a calendar that:

- can be made in various sizes,
- can be made in various colors,
- is sturdy and is easily displaced,
- is convenient to store and to mail when placed in a folded configuration, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 2 also shows a set of ring fasteners that attach the three sections comprising the calendar.

BEST MODE FOR CARRYING OUT THE INVENTION

Figure 1:
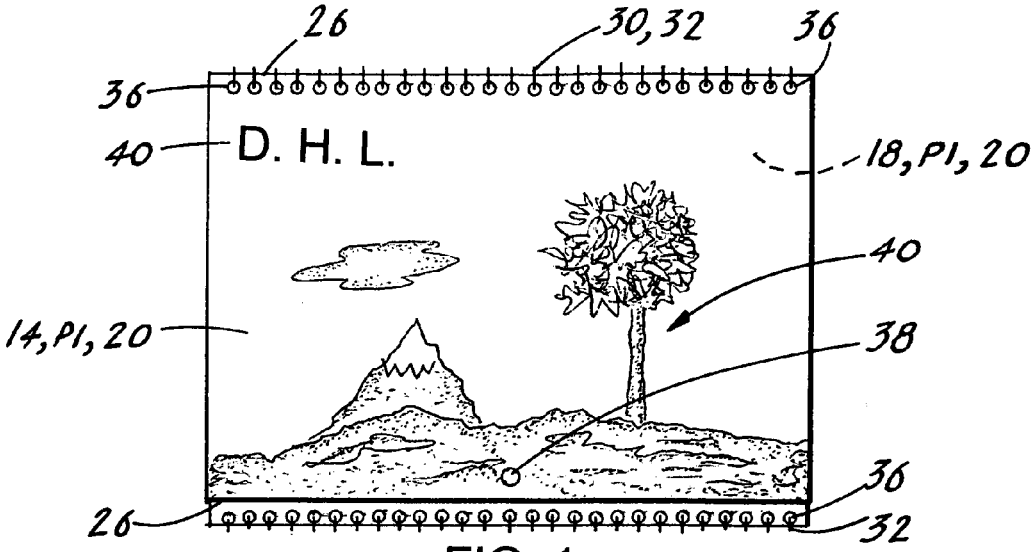
FIG. 1 is a front elevational view of a three-view foldable calendar shown in a folded configuration with indicia located on the front surface and with a spiral fastener attaching the three sections comprising the calendar.
Figure 2:
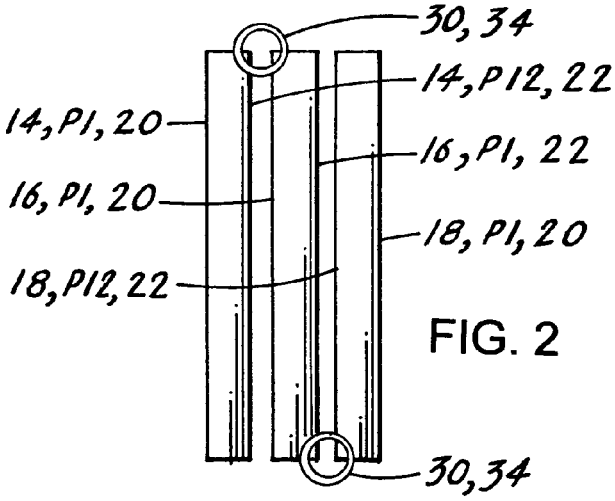
FIG. 2 is a side elevational view showing a front section and a lower section folded over a center section which allows the calendar to be placed in a folded configuration.
Figure 15:
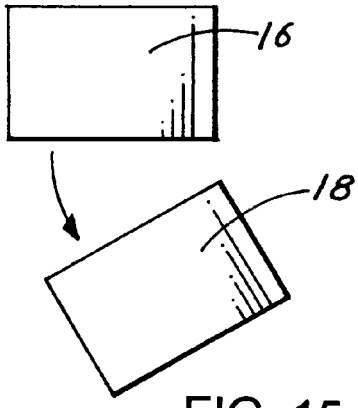
FIG. 15 is a perspective view of a lower section being removed from the lower edge of the center section which is necessary before a subsequent three-view configuration is displayed.
Figure 5:
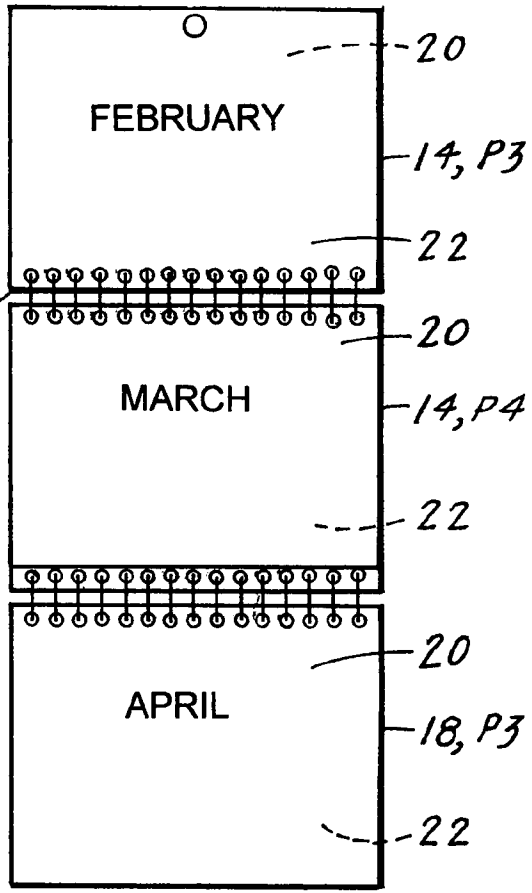
FIGS. 3–14 are front elevational views showing the twelve three-view viewing configurations.
Figure 4:
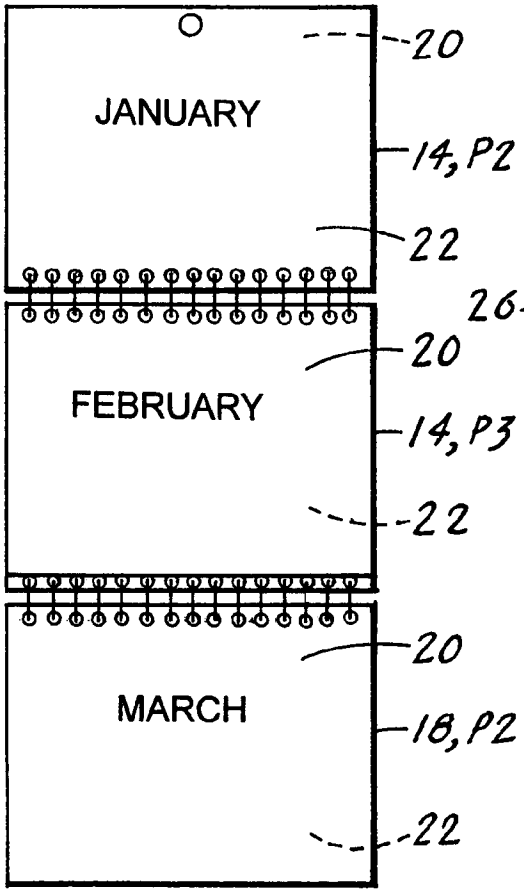

The best mode for carrying out the invention is presented in terms of a preferred embodiment for a three-view foldable calendar (hereinafter "calendar 10"). The calendar 10, as shown in FIGS. 1–15, is comprised of single integrated structure 12 that includes three articulated sections: an upper section 14, a center section 16 and a lower section 18. The calendar 10 is designed to be configured in either a storage or mailing configuration, as shown in FIGS. 1 and 2, or as shown in FIGS. 3–14, in a three-view viewing configuration. To place the calendar 10 in the folded position the upper section 14 and the lower section 18 are folded over the center section 16 as best shown in FIG. 2.

The upper section 14 consists of twelve pages P1 through P12 wherein each page has a front surface 20, a rear surface 22, an upper edge 24 and a lower edge 26. The center section 16 consists of a single page P1 that has a front surface 20, a rear surface 22, an upper edge 24 and a lower edge 26. The upper edge 24 of the center section 16 is foldably attached by a fastening means 30 to the lower edge 26 of the pages P1–P12 that comprise the upper section 14. Likewise, the lower section 18 consists of twelve pages P1 through P12 wherein each page has a front surface 20, a rear surface 22, an upper edge 24 and a lower edge 26. The upper edge 24 of the pages P1–P12 comprising the lower section 18 are also attached by a fastening means 30 to the lower edge 26 of page P1 of the center section 16.

The pages of the calendar 10 are preferably made of a high-quality cardboard. However, other materials such as paper, plastic, wood or metal can be used. Also, the fastening means 30 is preferably comprised of a spiral fastener 32, as shown in FIGS. 1 and 3–14. However, as shown in FIG. 2, a plurality of ring fasteners 34 can also be used. In either case, the fasteners 32,34 are inserted into a set of corresponding perforations 36 as also shown in FIGS. 1 and 3–14. Also to further enhance the utility of the calendar 10, indicia 40 in the form of advertising indicia or artistic indicia can be placed on the front surface 20 of the first page of the upper section 14, as shown in FIG. 1. To allow the calendar 10 to be displayed, a centered hanging hole 38 is located adjacent to the upper edge 24 of the upper section 14 as shown in FIGS. 3–14. To effect the display a pin (not shown) is inserted into the hole 38 and into a wall at which time the calendar 10 is secured to the wall in the viewing configuration.

When the calendar 10 is placed in the viewing configuration three consecutive calendar months are simultaneously displayed for comparative viewing.

As shown in FIGS. 3–14, twelve three-view viewing configurations are provided:

1) a first viewing configuration that includes the months of December, January and February, 2) a second viewing configuration that includes the months of January, February and March, 3) a third viewing configuration that includes the months of February, March and April, 4) a fourth viewing configuration that includes the months of March, April and May, 5) a fifth viewing configuration that includes the months of April, May and June, 6) a sixth viewing configuration that includes the months of May, June and July, 7) a seventh viewing configuration that includes the months June, July and August, 8) an eighth viewing configuration that includes the months of July, August and September, 9) a ninth viewing configuration that includes the months of August, September and October, 10) a tenth viewing configuration that includes the months of September, October and November, 11) an eleventh viewing configuration that includes the months of October, November and December, and 12) a twelfth viewing configuration that includes the months of November, December and January.

Figure 3:
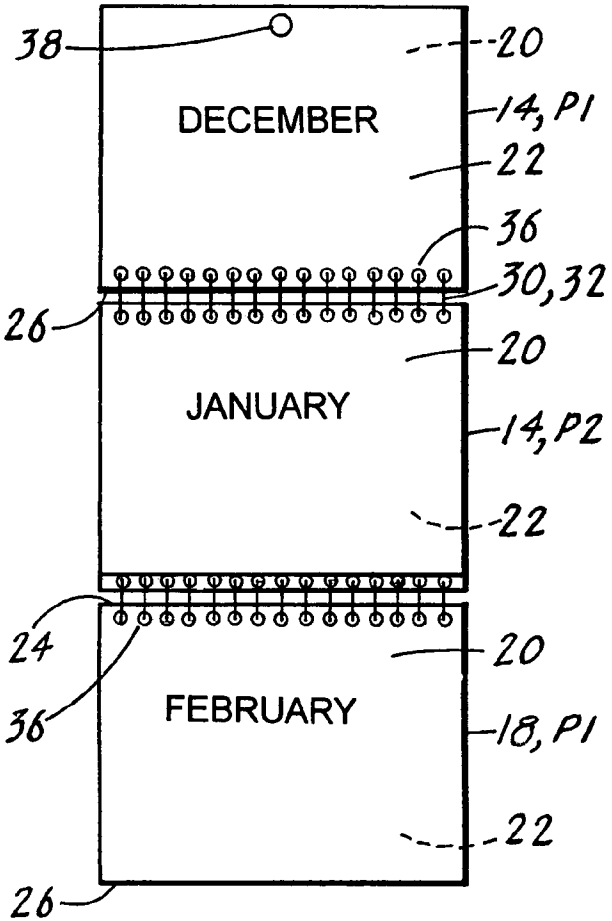
Figure 8:
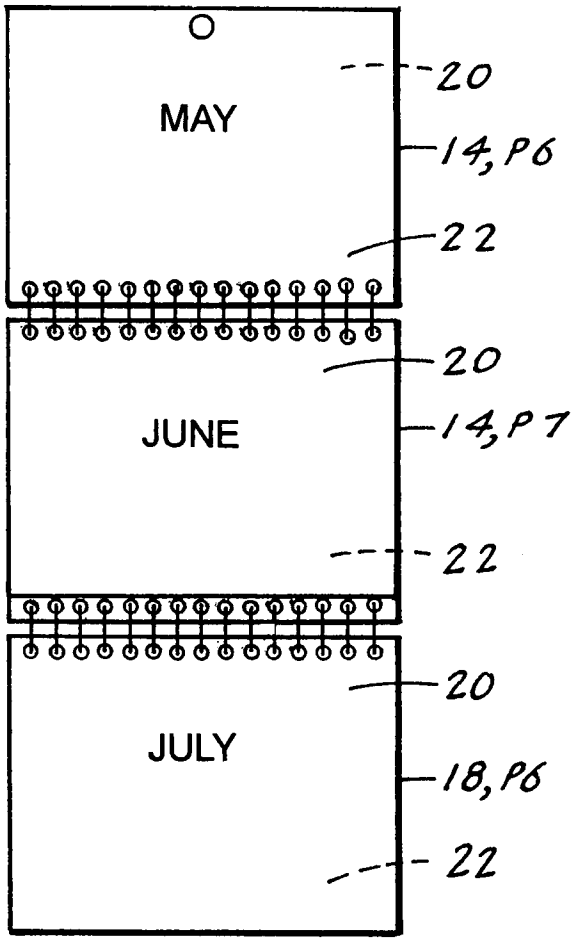
Figure 7:
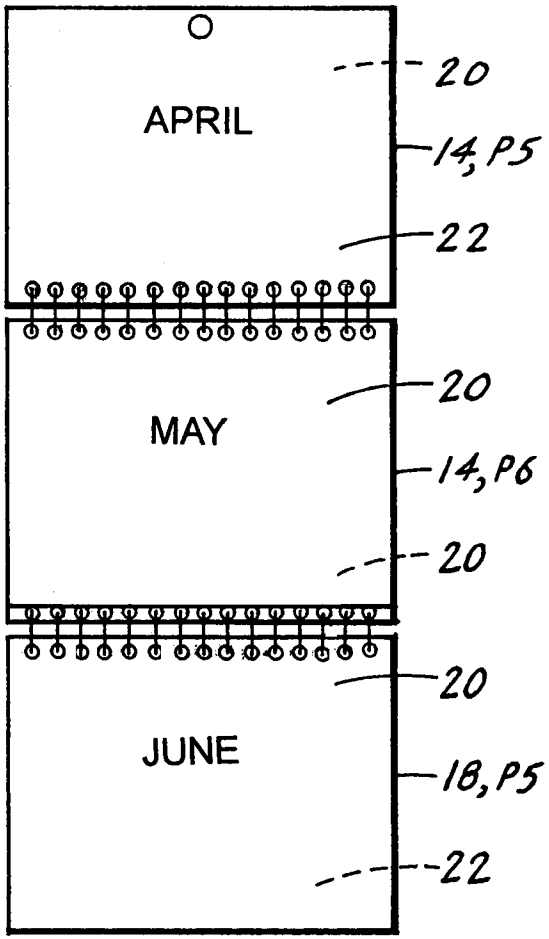
Figure 6:
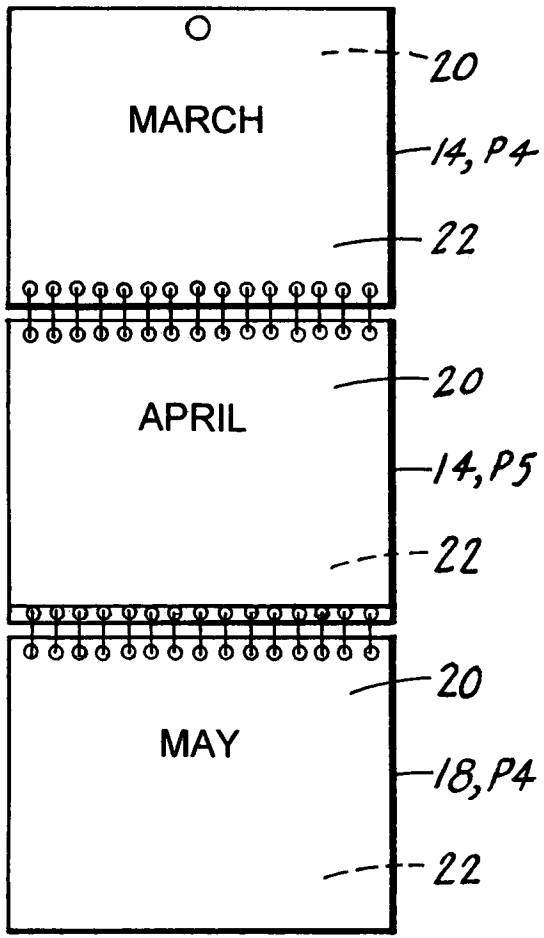
Figure 11:
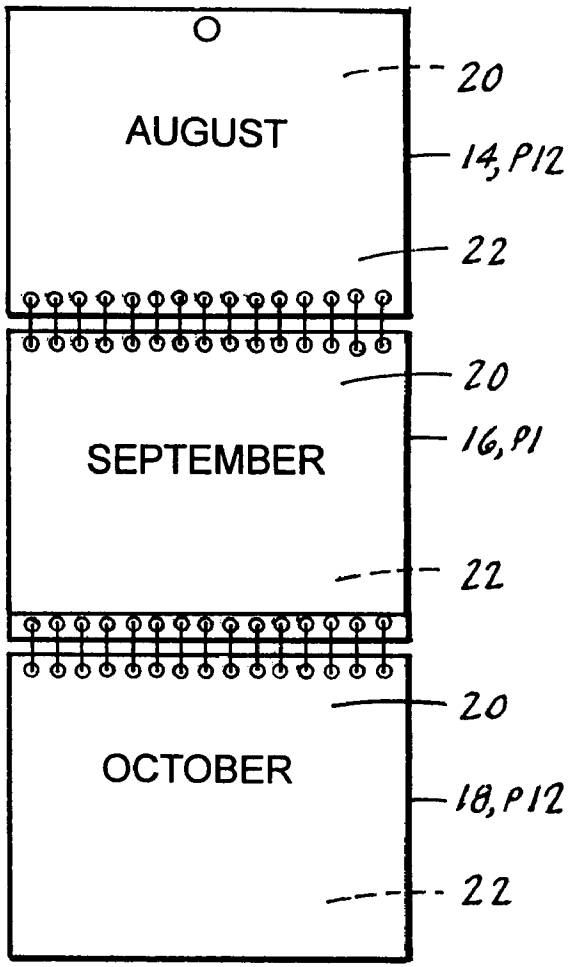
Figure 10:
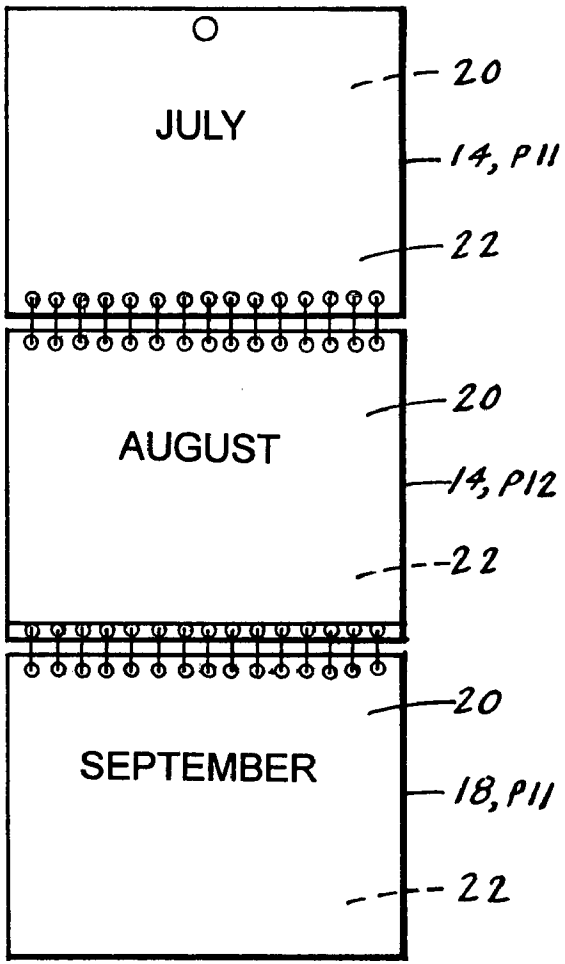
Figure 9:
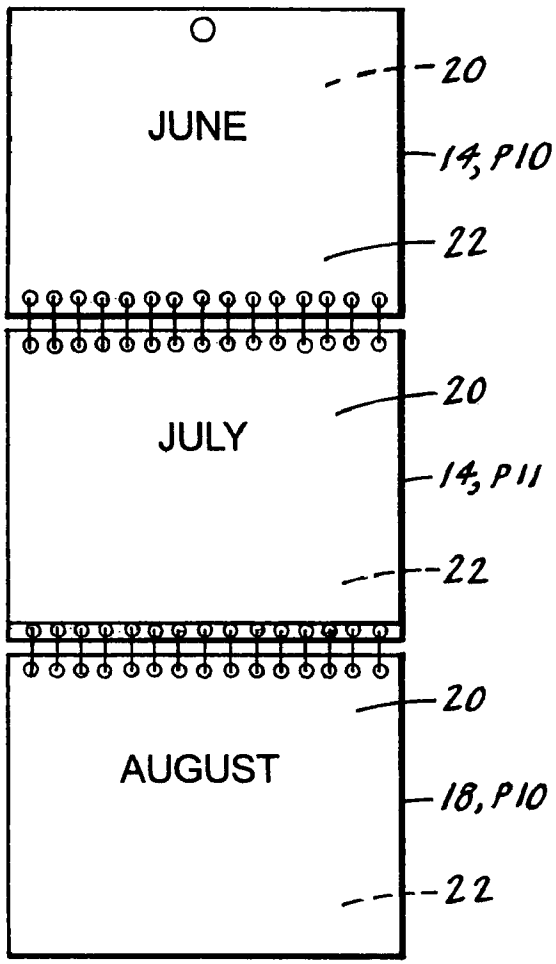
Figure 14:
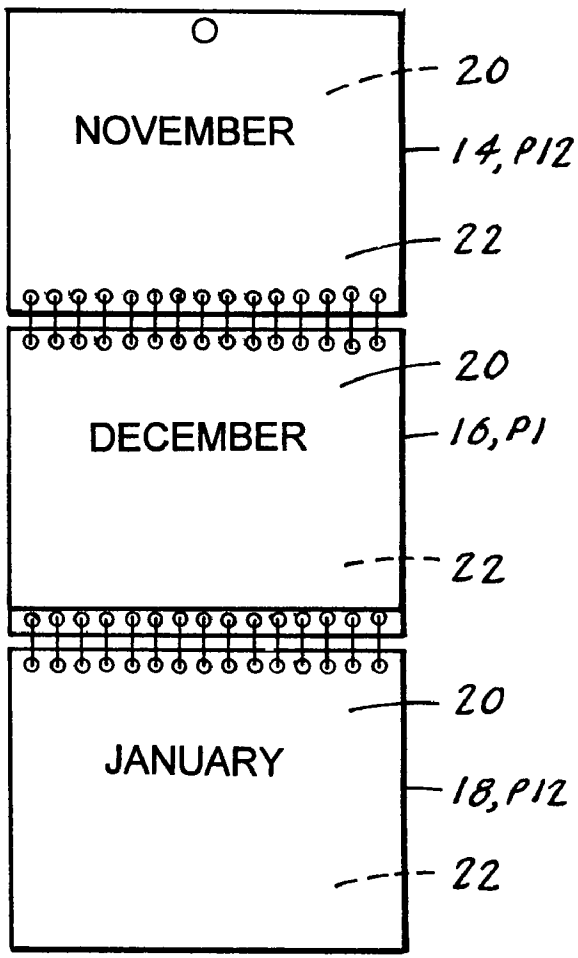
Figure 13:
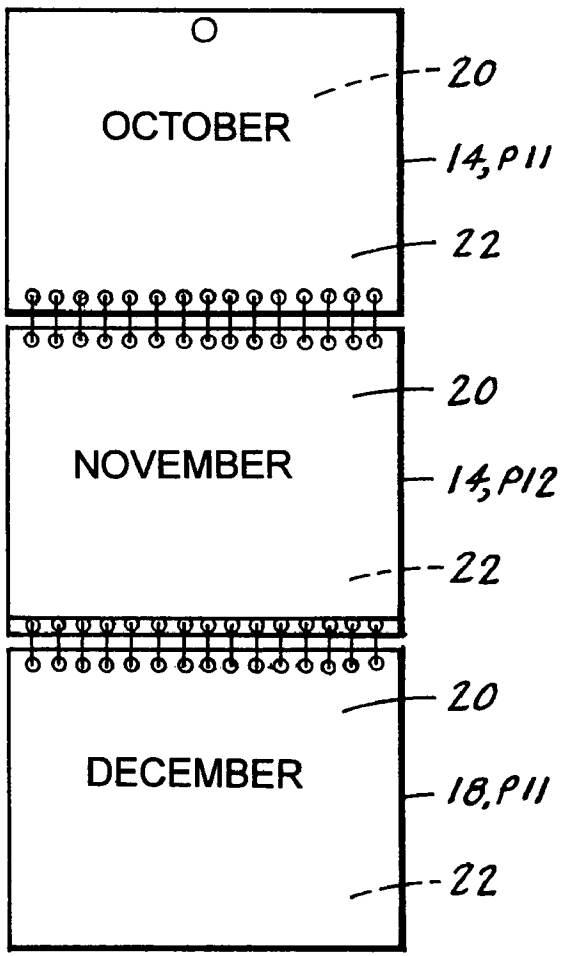
Figure 12:
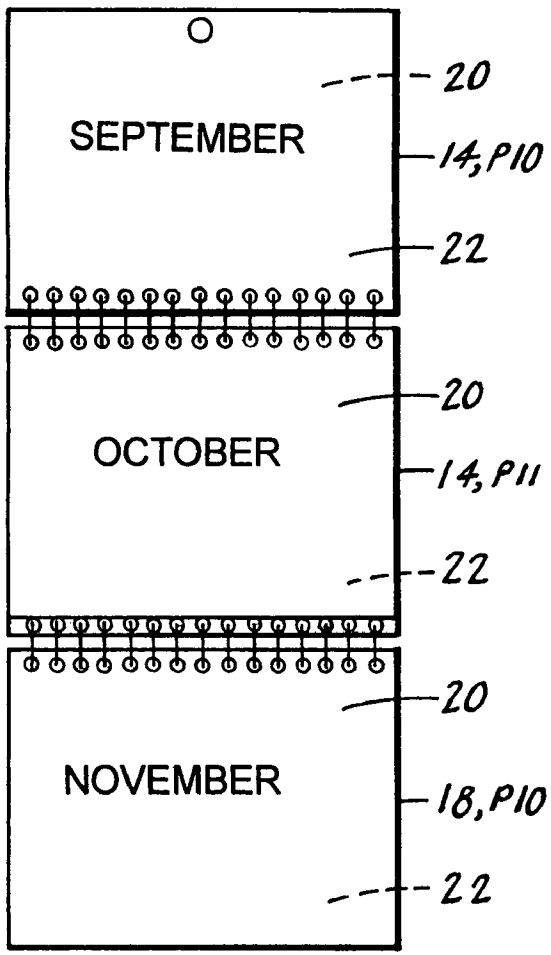

In the first three-view viewing configuration, as shown in FIG. 3, the month of December corresponds to the previous year. Likewise, in the twelfth three-view viewing configuration, as shown in FIG. 14, the month of January corresponds to the following year.

To utilize the inventive calendar 10 the initial three-view configuration showing the months of December, January and February, as shown in FIG. 3, are displayed. Before subsequent three-view configurations can be viewed, the pages of the lower section 18 must be singularly removed, as typically shown in FIG. 15.

Thus, before:

a) the second viewing configuration is viewed page P1 of the lower section is removed, b) the third viewing configuration is viewed page P2 of the lower section is removed, c) the fourth viewing configuration is viewed page P3 of the lower section is removed, d) the fifth viewing configuration is viewed page P4 of the lower section is removed, e) the sixth viewing configuration is viewed page P5 of the lower section is removed, f) the seventh viewing configuration is viewed page P6 of the lower section is removed, g) the eighth viewing configuration is viewed page P7 of the lower section is removed, h) the ninth viewing configuration is viewed page P8 of the lower section is removed, i) the tenth viewing configuration is viewed page P9 of the lower section is removed, j) the eleventh viewing configuration is viewed page P10 of the lower section is removed, and k) the twelfth viewing configuration is viewed page P11 of the lower section is removed.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and cope of the claims.

The invention claimed is:

1. A three-view foldable calendar comprising:

a) an upper section consisting of twelve pages (P1 through P12) wherein each page has a front surface, a rear surface, an upper edge and a lower edge, b) a center section consisting of a single page (P1) having a front surface, a rear surface, an upper edge and a lower edge, wherein the upper edge is foldably attached by a fastening means to the lower edge of the pages comprising the upper section, and c) a lower section consisting of twelve pages (P1 through P12) wherein each page has a front surface, a rear surface, an upper edge and a lower edge, wherein the upper edge of the pages comprising the lower section are foldably attached by the fastening means to the lower edge of the center section, wherein said calendar is designed to be placed in:

1) a folded configuration when said calendar is to be stored or mailed or in:

(2) a three-view configuration that allows three consecutive calendar months to be displayed for comparative viewing, and d a hanging hole located adjacent to the upper edge of the first page of said upper section, wherein when said calendar is placed in the three-view viewing configuration, a pin is inserted into said hanging hole and into a wall to secure the calendar to the wall.

* * * * *